United States Patent [19]

DiMarco et al.

[11] Patent Number: 4,680,564

[45] Date of Patent: Jul. 14, 1987

[54] MULTI-POLE MOLDED CASE CIRCUIT BREAKER WITH A COMMON CONTACT OPERATING CROSSBAR MEMBER

[75] Inventors: Bernard DiMarco, Lilburn, Ga.; Charles W. Stanford, Bellefontaine, Ohio

[73] Assignee: Siemens-Allis, Inc., Atlanta, Ga.

[21] Appl. No.: 656,233

[22] Filed: Oct. 1, 1984

[51] Int. Cl.[4] ..... H01H 73/02

[52] U.S. Cl. ..... 335/16; 335/165; 335/202

[58] Field of Search ..... 335/16, 165, 172, 174, 335/189, 195, 202, 38

[56] References Cited

U.S. PATENT DOCUMENTS

| | | | |
|---|---|---|---|
| 3,012,118 | 10/1958 | Edmunds | 200/88 |
| 3,127,488 | 3/1964 | Bodenschatz | 200/106 |
| 3,530,414 | 2/1969 | Wagner | 335/174 |
| 3,783,428 | 1/1974 | Mater | 335/174 |
| 3,815,059 | 6/1974 | Spoelman | 335/16 |
| 3,842,376 | 10/1974 | Mune | 335/202 |
| 3,946,346 | 3/1976 | Oster et al. | 335/16 |
| 4,066,989 | 1/1978 | Krueger | 335/9 |
| 4,071,836 | 1/1978 | Cook et al. | 335/195 |
| 4,088,973 | 5/1978 | Kussy et al. | 335/6 |
| 4,097,830 | 6/1978 | Rys | 335/21 |
| 4,232,282 | 11/1980 | Menocal | 335/202 |
| 4,260,969 | 4/1981 | Troebel et al. | 335/38 |
| 4,270,035 | 5/1981 | Richter | 335/202 X |
| 4,346,357 | 8/1982 | Kussy et al. | 335/16 |
| 4,409,573 | 10/1983 | DiMarco et al. | 335/16 |
| 4,550,300 | 10/1985 | Jencks et al. | 335/16 |

*Primary Examiner*—George Harris

*Attorney, Agent, or Firm*—F. W. Powers; J. L. James

[57] ABSTRACT

A multipole molded case circuit breaker has a single handle assembly contained in a first pole along with a movable contact arm assembly. A second pole has a movable contact arm assembly connected to the first contact arm assembly by a crossbar member so that the arms move in unison during normal operation. Each pole contains a tripping mechanism for tripping the breaker pole. The breaker mechanisms are connected for uniform tripping of all poles.

9 Claims, 4 Drawing Figures

MULTI-POLE MOLDED CASE CIRCUIT BREAKER WITH A COMMON CONTACT OPERATING CROSSBAR MEMBER

CROSS REFERENCE TO RELATED APPLICATIONS

The subject matter described in this application is related to the material disclosed in co-filed patent applications SN 656,236 "A Molded Case Circuit Breaker Having A Reinforced Housing"—B. DiMarco and C. W. Stanford; SN 656,150 "Circuit Breaker Contact Arm Assembly Having A Magnetic Carrier"—B. DiMarco and C. W. Stanford, and SX1 656,230 "Magnetic Structure For Calibrating A Circuit Breaker'-'—W. Young.

BACKGROUND OF THE INVENTION

This invention relates to molded case circuit breakers and more particularly to a circuit breaker which has a common crossbar member for operation of all poles of a multi-pole circuit breaker simultaneously.

A circuit breaker normally serves the dual function of opening and closing a circuit. Where the circuit breaker consists of two or more poles, it is desirable to open or close all poles of the breaker at the same time under normal tripping conditions or normal overcurrent conditions. To accomplish this, there have been arrangements wherein the operating handles for each pole have been mechanically tied together externally so that operation of one handle would operate all handles. More modern circuit breakers are single-handle devices, that is, for a multi-pole arrangement there is but one operating handle. In this arrangement, the tripping mechanisms are internally mechanically linked by a common shaft so that operation of the handle opens or closes all poles. It can be understood, that these arrangements require more parts and are thus most costly than more simple arrangements. However, it is desirable to gang operate the poles of a multi-pole circuit breaker.

U.S. Pat. No. 4,409,573 which issued on Oct. 11, 1983 to Bernard DiMarco and Andrew J. Kralik disclose a circuit breaker which has a contact arm which is pivotable about a cross bar. In the three-pole version, the other two poles of the circuit breaker are also connected to the crossbar to facilitate opening and closing of all three poles of the circuit breaker in unison under normal operating conditions. However, the tripping mechanisms are connected by a shaft extending through all three poles. Accordingly, it can be appreciated that it would be highly desirable to provide a simple mechanism for operating the contact arms of all poles of a multi-pole circuit breaker in unison under normal conditions which is simple and can be changed in the field.

Because many circuit breakers are used in control panels and other apparatus where space is limited and at a premium, there is a tendency to minimize the size of circuit breakers where possible. Thus, it can be appreciated that it would be highly desirable to provide a compact circuit breaker arrangement for a multi-pole circuit breaker in which the contacts of the poles operate in unison during normal conditions.

Accordingly, it is an object of this invention to provide a compact multi-pole circuit breaker arrangement.

Another object of this invention is to provide a circuit breaker arrangement which has the contact arms operating in unison during normal conditions.

Another object of this invention is to provide a compact circuit breaker arrangement which is simple to assemble.

SUMMARY OF THE INVENTION

Briefly stated, in accordance with one aspect of the invention, the foregoing objects are achieved by providing a multi-pole molded case circuit breaker in which the tripping mechanisms for the poles are connected by a tongue and groove arrangement and the contact arms for the poles are tied together with a cross bar for operation in unison between the open and closed positions. By tieing the contact arm assemblies of the poles together, the operating handle mechanism of only one pole is required for the multi-pole configuration. This yields a compact arrangement which uses a minimum of components. By connecting the tripping mechanisms with a tongue and groove connection, it is simple to assemble the circuit breaker and to add poles.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 4:
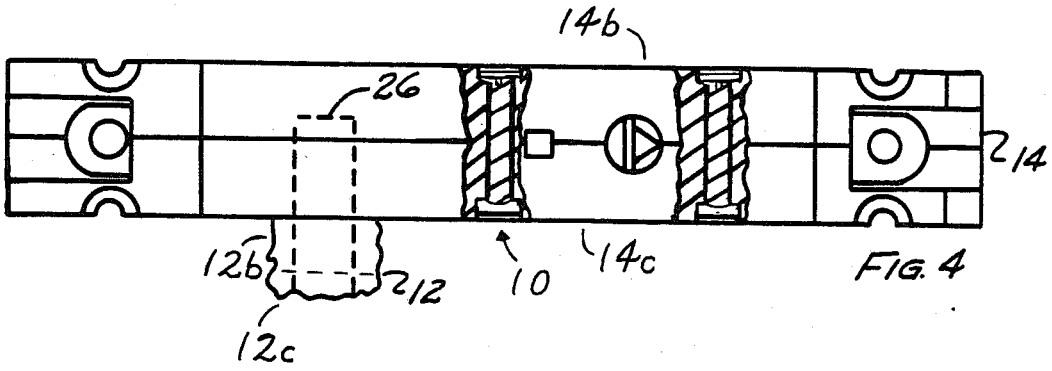
FIG. 4 is a front view similar to FIG. 2 but showing the left pole of FIG. 3 with the center pole of FIG. 2 shown in phantom..

Referring first to FIG. 4, there is shown a multi-pole circuit breaker 10 which has two poles. It has a center or first pole 12 and a left or second pole 14. Each pole is packaged in its own molded housing. The two houses are connected together to form a single molded case circuit breaker 10. While the embodiment of FIG. 4 basically shows a two-pole arrangement, a three-pole arrangement can also be used. To form a three-pole arrangement, a right pole is added to the two poles shown in FIG. 4. The left pole and the right pole are similar.

Figure 1:
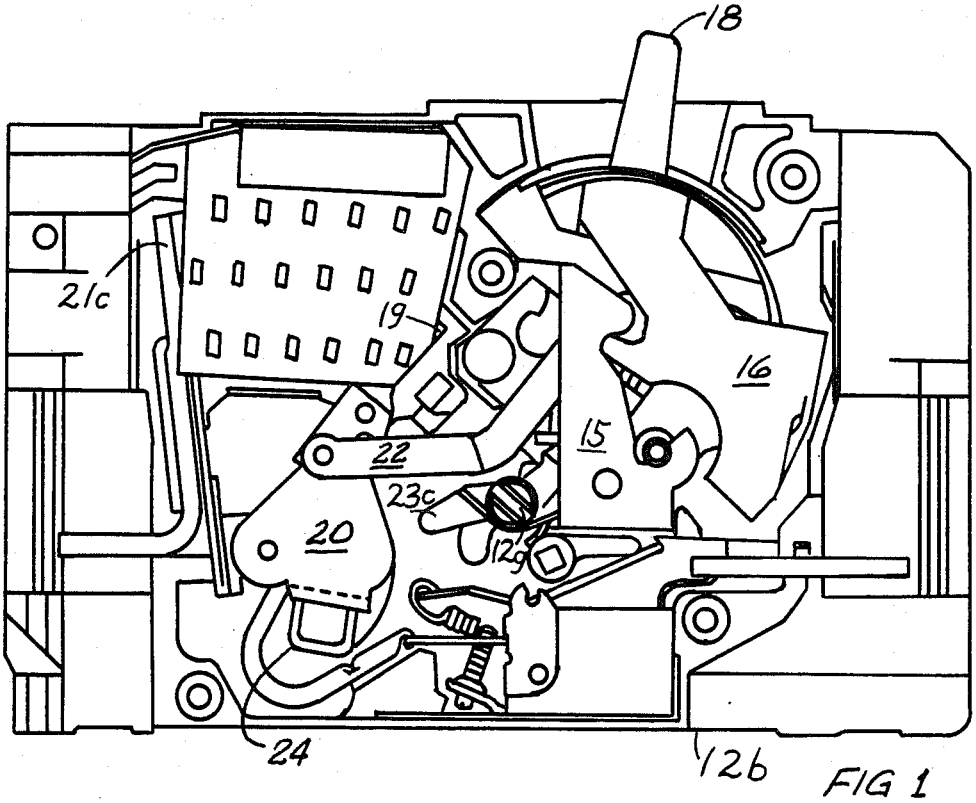
FIG. 1 is a view of the center pole of a circuit breaker with the cover removed exposing the components therein.
Figure 2:
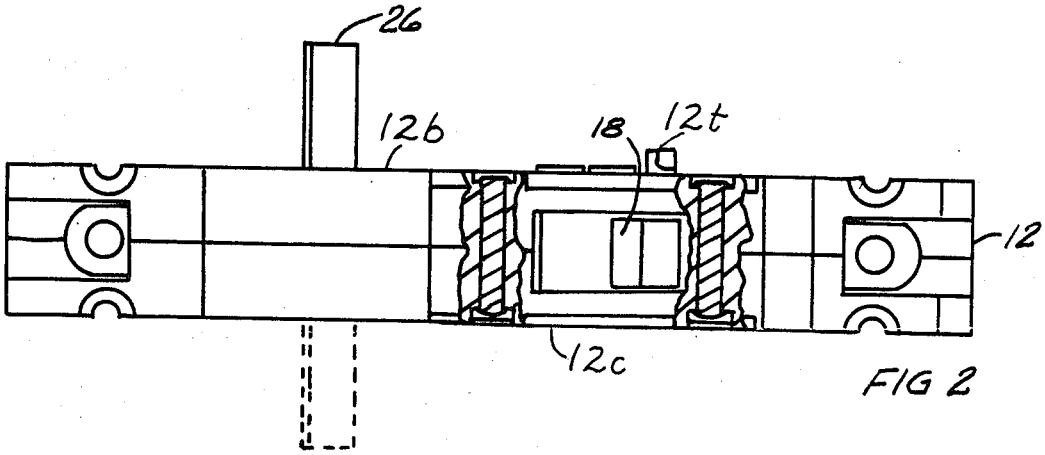
FIG. 2 is a front view of the pole of FIG. 1 showing the tripping mechanism and crossbar member connected.

Referring to FIGS. 1 and 2, the center pole is equipped with an operating handle assembly 16 which has an operating handle 18 which is operable between an ON position and an OFF position. The operating handle assembly 16 is unique to the center pole. Where left and right poles are used, these poles do not have an operating handle assembly as does the center pole. Thus, the multi-pole circuit breaker has but one operating handle assembly.

The center pole also contains a contact arm assembly 20 which has blow open contacts which are movable between a closed position and an open position. A linkage assembly 22 connects the handle assembly 16 and the contact arm assembly 20 so that the contacts may be opened and closed by moving the operating handle 18 between the closed and opened positions.

The center pole 12 contains a tripping mechanism 23C which is mounted in the housing and operable to trip the breaker 10. Movement of the handle 18 from the OFF position to the ON position closes the contacts and stores energy mechanically for tripping the breaker. In response to rotation of the tripping mechanism 23, the tripping energy is released opening the contacts. As mentioned, only the center pole contains the operating handle assembly 16 which stores the tripping energy. Where a left pole 14 is used, its tripping mechanism 23L engages the tripping mechanism 23C of the center pole 23 so that either pole can release the tripping energy. The tripping mechanisms 23L and 23C may interconnect by means of a tongue and groove connection or other convenient manner, such as a splined connection, for example. In this manner, operation of one tripping mechanism for any reason automatically and simultaneously operates the other tripping mechanisms thereby releasing the tripping energy.

The contact arm assembly 20 is equipped with a bracket 24 through which extends a crossbar member 26. The crossbar member is constructed of a very strong insulative material, such as glass epoxy, for example. The crossbar 26 may be a single piece or may consist of one piece per pole wherein the pieces are joined using a splined joint or other simple, secure joint. It has been found economically advantageous to form the crossbar 26 in a single piece. The crossbar fits in the bracket and is preferably secured therein by deforming the bracket about the crossbar. This may take the form of dimples or other indentations or a screw or fastener may be used. It has been found simple and efficient to use a slight indentation or dimple to secure the crossbar member to the bracket. By this construction, the crossbar member moves with the contact arm assembly. The crossbar member 26 moves with the bracket whether the contacts open because of severe over current or fault conditions or whether the motion is due to operation of handle 18 or the normal over current circuit interrupting function of the circuit breaker.

Figure 3:
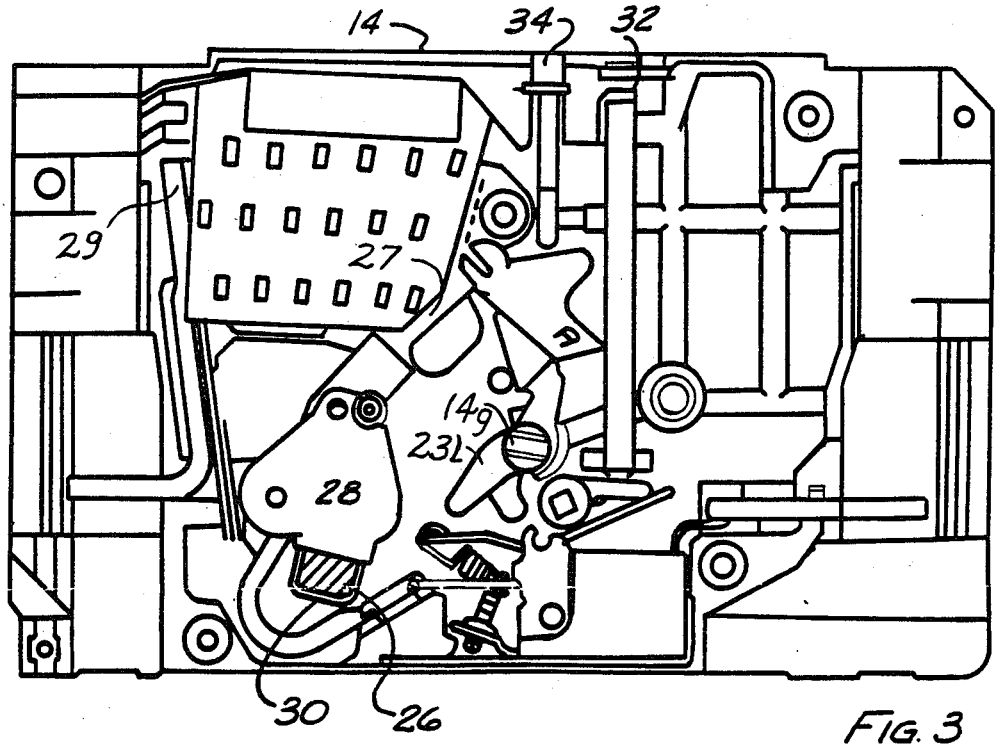
FIG. 3 is a view similar to FIG. 1 but showing a view of a left pole.

Referring to FIG. 3, the second or left pole 14 is similar to the main pole 12 except that the left pole does not have an operating handle assembly. The left pole does contain a contact arm assembly 28 which has a bracket 30 attached thereto. The bracket 30 simply slides onto the crossbar 26 so that adding a pole is a simple matter. The left pole 14 also contains a means 32 for adjusting the opening current and a means 34 for manually tripping the pole. The first and second poles also have tripping mechanisms 23C, 23L which interconnect so that when one pole trips, the other pole trips also.

Referring to FIGS. 1–4, the crossbar member 26 extends from the first pole 12 to the second pole 14. The crossbar member 26 extends from the bracket 24 of the main pole through an opening in the housing of the main pole 12 through an opening in the housing of the second pole 14 and into the bracket 30 of the contact arm assembly 28 of the second pole 14. By this construction, the operation of either contact arm is transmitted to the other contact arm assembly by the crossbar 26. This forces the contact arm assemblies to operate in unison. For example, pushing the trip button 34 releases the contact arm assembly 28 so that the contacts open. Because the contact arm assembly 20 is joined with contact arm assembly 28 by the crossbar member 26, the contact arm assembly 20 also opens. Similarly, when one of the contact arm assemblies contacts are opened due to an overcurrent condition, the opening force is transmitted through the crossbar member to the other contact arm assembly thereby opening its contacts simultaneously. Similarly, operation of handle 18 will also cause both contact arm assemblies to open or close simultaneously because of their connection by the crossbar member 26. The contact arm assemblies, because they are tied by the crossbar member 26, must operate in unison.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true script and spirit of the invention.

What is claimed as new and desired to be secured by Letters Patent of the United States is:

1. A multi-pole circuit breaker, comprising:

a first pole having a molded housing containing a frame mounted on the housing, a handle assembly mounted on the frame with a handle protruding through an opening in the housing and operable between an ON position and an OFF position, a fixed contact, a movable contact operable between an open position and a closed position, a linkage assembly connecting the movable and the handle assembly for movement of the contacts between the closed and open positions in response to movement of the handle between the ON and OFF positions, and a tripping mechanism having a tongue protruding through an opening in the housing;

a second pole having a molded housing containing a fixed contact, a movable contact operable between an open position and a closed position, a tripping mechanism with groove accessible through an opening in the housing and being mateable with said tongue; and a crossbar member connecting the movable contacts of the first and second poles, said contacts moving in unison with the crossbar in response to actuating the tripping mechanism.

2. A multi-pole circuit breaker, as set forth in claim 1, wherein both movable contact arms move in unison in response to operation of the handle.

3. A multi-pole circuit breaker, as set forth in claim 1, wherein the crossbar is secured to the first pole and the second pole slides onto the crossbar.

4. A multi-pole circuit breaker, as set forth in claim 1, wherein the crossbar has a first portion secured to the first pole and a second portion associated with the second pole, said first and second portions being mateable with one another for moving the contacts in unison during triping.

5. A multi-pole circuit breaker having a single handle mechanism assembly, comprising:

a first pole having a molded housing containing the single handle mechanism assembly, a contact arm assembly movable between an open position and a closed position, a linkage assembly connecting the contact arm assembly and the handle assembly for movement of the contacts between the closed and open positions in response to movement of the handle between an ON position and an OFF position and a tripping mechanism having a tongue protruding through an opening in the housing;

a second pole having a contact assembly operable between an open position and a closed position and a tripping mechanism having a groove accessible through an opening in the housing and being mateable with said-tongue; and a crossbar member connecting the contact arm assemblies for movement of the contact assemblies between the open and closed position in unison with the crossbar.

6. A multi-pole circuit breaker, as set forth in claim 5, wherein the crossbar is secured to the first pole and the second pole slides onto the crossbar.

7. A multi-pole circuit breaker, as set forth in claim 5, wherein the crossbar has a first portion secured to the first pole and a second portion associated with the second pole, said first and second portions being mateable with one another for moving the contacts in unison during tripping.

8. A multi-pole circuit breaker having a single handle assembly, comprising:

a first pole having a molded housing containing the single handle assembly, a contact arm assembly movable between an open position and a closed position, a linkage assembly connecting the contact arm assembly and the handle assembly for movement of the contacts between the closed and open positions in response to movement of the handle between an ON position and an OFF position and a tripping mechanism having a tongue protruding through an opening in the housing; and a second pole having a contact assembly operable between an open position and a closed position and a tripping mechanism having a groove accessible throuqh an opening in the housing and being mateable with said tongue.

9. A multi-pole circuit breaker, as set forth in claim 8, wherein the tripping mechanisms of the poles operate in concert to trip the breaker, tripping movement of one tripping mechanism being transmitted to the other tripping mechanism via the tongue and groove connection.

* * * * *